United States Patent [19]

Brenk et al.

[11] Patent Number: 4,853,093

[45] Date of Patent: Aug. 1, 1989

[54] ALUMINUM OR AN ALUMINUM ALLOY SUPPORT MATERIAL FOR USE IN OFFSET PRINTING PLATES

[75] Inventors: Michael Brenk; Renate Ernst, both of Wiesbaden, Fed. Rep. of Germany

[73] Assignee: Hoechst Aktiengesellschaft, Frankfurt am Main, Fed. Rep. of Germany

[21] Appl. No.: 114,771

[22] Filed: Oct. 30, 1987

[30] Foreign Application Priority Data

Nov. 6, 1986 [DE] Fed. Rep. of Germany ..... 3637764

[51] Int. Cl.[4] ..... C25D 5/44

[52] U.S. Cl. ..... 204/37.6; 204/33; 204/58; 428/472.2; 430/496; 430/526

[58] Field of Search ..... 204/33, 58, 42; 430/496, 526; 428/472.2

[56] References Cited

U.S. PATENT DOCUMENTS

| | | | |
|---|---|---|---|
| 2,287,148 | 6/1942 | Taber | 73/51 |
| 4,211,619 | 7/1980 | Usbeck | 204/33 |
| 4,634,656 | 1/1987 | Ohashi et al. | 204/33 |

FOREIGN PATENT DOCUMENTS

| | | |
|---|---|---|
| 0008212 | 2/1980 | European Pat. Off. . |
| 0048988 | 4/1982 | European Pat. Off. . |
| 48-9453 | 3/1973 | Japan . |
| 49-35239 | 4/1974 | Japan . |
| 52-120238 | 10/1977 | Japan . |
| 53-11843 | 2/1978 | Japan . |
| 54-31047 | 3/1979 | Japan . |
| 56-51388 | 5/1981 | Japan . |
| 57-85996 | 5/1982 | Japan . |
| 57-85998 | 5/1982 | Japan . |
| 58-177497 | 10/1983 | Japan . |
| 1243741 | 8/1971 | United Kingdom . |

OTHER PUBLICATIONS

Wernick and Pinner, "The Surface Treatment and Finishing of Aluminum and Its Alloys", vol. 1, pp. 304–309, Robert Draper Ltd., Teddington, 1972.

*Primary Examiner*—R. L. Andrews

*Attorney, Agent, or Firm*—Foley & Lardner, Schwartz, Jeffery, Schwaab, Mack, Blumenthal & Evans

[57] ABSTRACT

There is disclosed a plate-, foil- or web-shaped support material for offset printing plates, made of mill-finished, mechanically and/or chemically or mechanically and electrochemically grained aluminum or an aluminum alloy, which has been anodized in aqueous-alkaline solutions. The support material of the invention shows a reflectometer value, at an angle of incidence of 60° (measured according to DIN 67 530; 1982), of greater than 5, an abrasion of the oxide layer of less than 0.5 $g/m^2$ and a resistance to alkali of greater than 140 s. Also disclosed is a process for the manufacture of the support material, in which an anodic oxidation is carried out in an electrolyte having a pH greater than or equal to 12.5, at a voltage of less than 50 V.

19 Claims, No Drawings

ALUMINUM OR AN ALUMINUM ALLOY SUPPORT MATERIAL FOR USE IN OFFSET PRINTING PLATES

BACKGROUND OF THE INVENTION

This invention relates to an improved support material based on aluminum or an aluminum alloy for use in offset printing plates. The invention also relates to a process for the manufacture of the support material.

Support materials for offset printing plates are provided, on one or both sides, with a radiation(photo-) sensitive layer (reproduction layer), either directly by the user or by the manufacturers of precoated printing plates. This layer permits the production of a printing image of an original by photomechanical means. Following the production of this printing form from the printing plate, the layer support carries the image areas which accept ink in the subsequent printing process and, simultaneously, there is formed, in the areas which are free from an image (non-image areas) in the subsequent printing process, the hydrophilic image background for the lithographic printing operation.

For the above reasons, the following requirements are demanded of a layer support for reproduction layers used in the manufacture of offset printing plates:

- Those portions of the radiation-sensitive layer which have become comparatively more soluble following exposure must be capable of being easily removed from the support by a developing operation, in order to produce the hydrophilic non-image areas without leaving a residue, and without the developer substantially attacking the support material.
- The support, which has been laid bare in the nonimage areas, must possess a high affinity for water, i.e., it must be strongly hydrophilic, in order to accept water rapidly and permanently during the lithographic printing operation, and to exert an adequate repelling effect with respect to the greasy printing ink.
- The radiation-sensitive layer must exhibit an adequate degree of adhesion prior to irradiation (exposure), and those portions of the layer which print must exhibit adequate adhesion following irradiation.
- The support material should possess high mechanical strength, e.g., with respect to abrasion, and good chemical resistance, particularly to the action of alkaline media.

As the base material employed for layer supports of this type, aluminum is frequently used. It is superficially grained by means of known methods, such as dry brushing, slurry brushing, sandblasting, chemical and/or electrochemical treatment. Especially the electrochemically grained substrates are then subjected to an anodizing treatment, during which a thin oxide layer is built up, in order to improve the abrasion resistance. These anodic oxidation processes are usually performed in electrolytes such as $H_2SO_4$, $H_3PO_4$, $H_2C_2O_4$, $H_3BO_3$, amidosulfonic acid, sulfosuccinic acid, sulfosalicylic acid or mixtures thereof. The oxide layers built up in these electrolytes or electrolyte mixtures are distinguished from one another by their structures, layer thicknesses and resistance to chemicals. Aqueous solutions of $H_2SO_4$ or $H_3PO_4$ are predominantly employed in the industrial production of offset printing plates. As far as electrolytes containing $H_2SO_4$ are concerned, reference is made, for example, to European Patent No. 0,004,569 (=U.S. Pat. No. 4,211,619) and to the prior art publications mentioned therein.

Aluminum oxide layers produced in aqueous electrolytes containing $H_2SO_4$ are amorphous and, in the case of offset printing plates, in general have a layer weight of about 0.5 to 10 g/m$^2$, which corresponds to a layer thickness of about 0.15 to 3.0 μm. When a support material, which has been anodically oxidized in this way, is used for offset printing plates, a disadvantage is presented by the relatively low resistance of oxide layers produced in $H_2SO_4$ electrolytes to alkaline solutions. Solutions of this type are employed, to an increasing extent, for example, in the processing of presensitized offset printing plates, preferably in state-of-the-art developer solutions for irradiated negative-working or, in particular, positive-working radiation-sensitive layers. Furthermore, these aluminum oxide layers often tend to a more or less irreversible adsorption of substances from the applied reproduction layers, which may, for example, lead to a coloration of the oxide layers ("staining"). The supports anodized in this way are relatively dark and exhibit unfavorable values of mechanical abrasion.

It is also known to anodically oxidize aluminum in aqueous electrolytes containing oxyacids of phosphorus and optionally additional compounds, as described, for example, in German Offenlegungsschrift No. 32 06 470; this publication also gives a detailed evaluation of the prior art. The plates so produced look somewhat lighter than the plates anodized with sulfuric acid and they also have, for example, an improved resistance to abrasion and alkaline media, but they still do not have the desired silvery appearance and tend to halations.

Moreover, currentless alkaline treatments of aluminum oxide surfaces are, for example, disclosed in Patent of the German Democratic Republic No. 208 176, Japanese Patent Application Disclosure Nos. 57/177 497 and 56/051 388 and in German Offenlegungsschrift No. 32 19 922.

Japanese Patent Application Disclosure Nos. 57/085 998 and 57/085 996 describe a process for the anodization of solar heat energy absorbing plates, in which the electrolyte used contains, in addition to an alkali metal hydroxide, also an acid and sodium phosphate, a polyalcohol or a fluoride. Because of these additives, the pH of the electrolyte is too low for an application in the process of the present invention. The oxide layers obtainable with this electrolyte under technically appropriate conditions are consequently not as thick as the oxide layers which are advantageous for lithographic purposes. Besides, the addition of a fluoride increases the corrosive character of the electrolyte, which leads to an ugly gray appearance of the treated surface.

European Patent Application No. 0 048 988 describes a multi-stage process for coloring the surface of aluminum, in which streak patterns are formed. The material employed in this process has previously been anodized. In the second process stage—the coloring stage—an electrolyte is used, which contains alkali metal ions and additives which lead to the streak pattern. The additives mentioned comprise alkali metal phosphates or borates or alkaline earth metal compounds and an acid which serves to adjust the pH to a value below 5.0. Some alkaline electrolytes are known for producing a thin, but very dense electrically insulating barrier layer which prevents the formation of an oxide layer which is sufficiently thick for lithographic applications (see, for example, Wernick and Pinner: "The Surface Treatment and Finishing of Aluminium and its Alloys", Vol. 1, page 304 et seq., Robert Draper Ltd., Teddington 1972). This applies in the case of anodizing treatments in alkali metal phosphate solutions, which are described, e.g. in Japanese Patent Appln. Disclosure No. 54/031 047 and in German Offenlegungsschrift No. 28 42 396, in the case of electrolytes containing borates as the main constituents, as described in European Patent Application No 0 008 212, in Japanese Patent Appln. Disclosure No. 49/035239 and in British Pat. No. 1 243 741 and also in the case of electrolytes containing ammonium salts, as proposed by Japanese Patent Publication No. 9453/73.

In weakly alkaline solutions as described, for example, in Japanese Patent Appln. Disclosure No. 52/120 238 sufficiently thick oxide layers cannot be obtained, when technically appropriate voltages are applied during treatment times which are as short as required in modern continuously working processing units.

Japanese Patent Appln. Disclosure No. 53/011 843 recommends an electrolyte which may comprise an acidic or alkaline solution and contains a chloride. An aluminum material treated with this electrolyte has an unsightly, irregular gray surface, due to the corrosive action of the chloride ions.

SUMMARY OF THE INVENTION

It is an object of the present invention to provide a support material based on aluminum or an aluminum alloy, which simultaneously shows an improved resolution of the plates coated with a photosensitive layer, a high contrast between nonimage and image areas, a high oxide layer weight, an increased resistance to abrasion, a high resistance to alkali and a good adhesion between support and photosensitive layer.

It is also an object of this invention to provide a process for the anodic oxidation of millfinished or grained, sheet-like aluminum which is suitable for use as a support material for offset printing plates, which process can be performed in a modern processing unit, relatively quickly and without any great expenditure of equipment and process engineering.

In accordance with these and other objects of the invention there is provided a support material for offset printing plates of aluminum or aluminum alloy which has been anodized in alkaline solution. The support material has a reflectometer value, at an angle of incidence of 60° (measured according to DIN 67 530; 1982), of greater than about 5, an abrasion of the oxide layer of less than about 0.5 g/m$^2$ and a resistance to alkali of greater than about 140 s. In a preferred embodiment, the material has a reflectometer value greater than or equal to about 15, an abrasion of the oxide layer less than or equal to about 0.3 g/m$^2$ and a resistance to alkali of greater than or equal to about 160 s.

The process provided for manufacture of the support material comprises anodic oxidation in an alkaline electrolyte having a pH greater than or equal to about 12.5. The voltage used is less than about 50 V.

DESCRIPTION OF THE PREFERRED EMBODIMENTS

The invention is based on a plate, foil or web-shaped support material for offset printing plates, comprising mill-finished, mechanically and/or chemically or mechanically and electrochemically grained aluminum or an aluminum alloy, which has been anodically oxidized in alkaline solutions.

It is a characterizing feature of this invention that the support material shows a reflectometer value at 60° (measured according to DIN 67 530, 1982) greater than 5, an abrasion of the oxide layer of less than 0.5 g/m$^2$ and a resistance to alkali of greater than 140 s. The preferred reflectometer value of the support material is greater than or equal to 15. The preferred value of abrasion of the oxide layer is less than or equal to 0.3 g/m$^2$ and resistance to alkali is preferably greater than or equal to 160 s. The oxide layer formed on the support material advantageously has a weight per unit area of greater than 0.8 g/m$^2$.

The process of the invention for the manufacture of the support material is based on a process, in which plate, foil or web-shaped aluminum is mechanically and/or chemically and/or electrochemically grained and anodized in an aqueous alkaline electrolyte.

The process is characterized in that the electrolyte has a pH greater than or equal to 12.5 and that the voltage is adjusted to a value below 50 V. The electrolyte comprises water and from about 0.1 to 20% by weight, preferably from about 0.5 to 10% by weight, of solid substances. At least about 60% by weight of the anhydrous solids content of the electrolyte preferably comprises an alkali metal hydroxide. The balance may be comprised of an alkali metal salt of a weak acid, of surface-active agents and of aluminum ions, but these constituents are not essential for the functioning of the process.

When alkali metal salts of weak acids are dissolved in water, alkaline solutions are obtained. The alkali metal salts of weak acids selected in the process of the present invention include those which give about 1% by weight aqueous solutions (of the anhydrous salts) having a pH of at least 10.5. Suitable salts are, for example, some alkali metal carbonates, alkali metal silicates and alkali metal phosphates and also alkali metal aluminates.

The choice of the surface-active agents is of minor importance. The agent selected should not decompose very rapidly under the conditions of the anodic oxidation, such that the electrolyte does not have to be regenerated too frequently. It is, for example, possible to add sodium octyl sulfate. An amount of about 1% by weight is sufficient, however, a larger amount can also be added without detrimental consequences.

Aluminum ions are introduced into the electrolyte in any case by dissolution of the anode material during the anodizing process. They can also be added to the electrolyte before anodization is started, in order to reduce the relative change in the electrolyte composition occurring in the course of anodizing by dissolution of the anode material. However, an increased content of aluminum ions in the electrolyte reduces the current flow in the anodizing process. Aluminum ions can be added until the weight ratio between alkali metal hydroxide and aluminum ions is approximately 6:1, but appropriately less aluminum ions are used. Aluminum may, for example, be added to the electrolyte in the form of an alkali metal aluminate.

The concentration ranges of the constituents of the electrolyte are checked at regular intervals, since they are of prime importance for an optimum procedure and the electrolyte is then regenerated discontinuously or continuously. The process according to the present invention may be run discontinuously or, in particular, continuously. In the practice of this invention, a good circulation of the electrolyte is preferred. This can be effected by stirring or pump circulating the electrolyte.

In a continuous procedure care has to be taken to conduct the electrolyte as far as possible parallel to the web to be treated, at a turbulent flow and at high speed to ensure a good exchange of substance and heat. The flow rate of the electrolyte relative to the web is appropriately higher than about 0.3 m/s. The type of current used is, in particular, direct current, however, it is also possible to use alternating current or a combination of these current types (e.g. direct current with superposed alternating current or asymmetric current types). Voltages are generally in the range between about 2 and 50 V, current densities range from about 3 to 50 A/dm$^2$, temperatures from about 10° to 50° C. and treatment times from about 5 to 500 seconds.

The oxide layer weight which can be obtained in the process of the invention increases with rising current densities and longer anodizing times, however, an increasing duration of anodization entails a drop in current efficiency.

Although the strongly alkaline electrolyte is very corrosive and can rapidly dissolve aluminum oxide, oxide layer weights of about 2 g/m$^2$ and even higher can unexpectedly be obtained in this electrolyte. The resistance of the oxide layer to mechanical abrasion increases with an increasing oxide layer weight. The correction contrast (appearance of light areas on a stained background following corrections) and "staining" are almost independent of the electrolyte concentration. With increasing anodizing times at constant oxide layer weights, improved values of the resistance to mechanical abrasion are usually observed.

The oxide layers produced in this way combine the advantages known from supports which have been anodically oxidized in phosphoric acid, such as a bright, silvery color, very good resistance to alkali and low tendency to staining, with the advantage of supports which have been anodically oxidized in sulfuric acid, namely a relatively high oxide layer weight and, as a result thereof, improved values of the resistance to mechanical abrasion.

Suitable base materials for the material to be oxidized in accordance with this invention include aluminum or one of its alloys which, for example, have an Al content of more than about 98.5% by weight and additionally contain small amounts of Si, Fe, Ti, Cu and Zn. These aluminum support materials are, optionally after a precleaning step, grained mechanically (e.g., by brushing and/or treatment with an abrasive) and electrochemically (e.g., by an a.c. treatment in aqueous HCl, $HNO_3$ or salt solutions) or only electrochemically. All process steps can be carried out discontinuously, but they are preferably performed continuously.

In particular in continuous processes, the process parameters in the electrochemical graining step are normally within the following ranges: temperature of the electrolyte about 20° C. to 60° C., concentration of active substances (acid, salt) between about 2 g/l and 100 g/l (in the case of salts even higher), current density about 15 to 250 A/dm$^2$, dwell time in the electrolyte about 3 to 100 seconds, and rate of flow of the electrolyte on the surface of the material to be treated about 5 to 100 cm/s. The type of current used usually is alternating current, but it is also possible to use modified current types, such as alternating current having different current intensity amplitudes for the anodic and for the cathodic current. The average peak-to-valley height $R_z$ of the grained surface is in a range from about 1 to 15 μm. The peak-to-valley height is determined according to DIN 4768, October 1970 version, the peak-to-valley height $R_z$ then being the arithmetic mean of the individual peak-to-valley heights of five mutually adjoining individual measuring sections.

Precleaning includes, for example, treatment with an aqueous NaOH solution with or without a degreasing agent and/or complex formers, trichloroethylene, acetone, methanol or other commercially available so-called "aluminum pickles". Following graining or, in the case of several graining steps, between the individual steps, it is possible to perform an additional etching treatment, during which in particular a maximum amount of about 2 g/m$^2$ is removed (between the individual steps, even up to 5 g/m$^2$). Etching solutions in general are aqueous alkali metal hydroxide solutions or aqueous solutions of salts showing alkaline reactions or aqueous solutions of acids on a basis of $HNO_3$, $H_2SO_4$ or $H_3PO_4$. Apart from an etching treatment step performed between the graining step and the anodizing steps, nonelectrochemical treatments are also known, which have a purely rinsing and/or cleaning effect and are, for example, employed to remove deposits which have formed during graining ("smut"), or simply to remove electrolyte remainders; dilute aqueous alkali metal hydroxide solutions or water can, for example, be used for these treatments. In many cases, however, it is not necessary to perform a treatment of this kind, since the anodizing electrolyte has an adequate etching action.

The step of an anodic oxidation of the aluminum support material is optionally followed by one or several post-treating steps. In particular when the process of this invention is employed, these post-treating steps are often not required. Post-treating particularly means a hydrophilizing chemical or electrochemical treatment of the aluminum oxide layer, for example, an immersion treatment of the material in an aqueous solution of polyvinyl phosphonic acid according to German Pat. No. 16 21 478 (=British Published Application No. 1,230,447) or an immersion treatment in an aqueous solution of an alkali-metal silicate according to German Auslegeschrift No. 14 71 707 (=U.S. Pat. No. 3,181,461). These post-treatment steps serve, in particular, to improve even further the hydrophilic properties of the aluminum oxide layer, which are already sufficient for many applications, with the other well-known properties of the layer being at least maintained.

The materials prepared in accordance with this invention are used as supports for offset printing plates, i.e., one or the two surfaces of the support material are coated with a photosensitive composition, either by the manufacturers of presensitized printing plates or directly by the users. Suitable radiation-(photo-) sensitive layers basically include all layers which after irradiation (exposure), optionally followed by development and/or fixing, yield a surface in imagewise configuration which can be used for printing.

Apart from the silver halide-containing layers used for many applications, various other layers are known which are, for example, described in "Light-Sensitive Systems" by Jaromir Kosar, published by John Wiley & Sons, New York, 1965: colloid layers containing chromates and dichromates (Kosar, Chapter 2); layers containing unsaturated compounds, in which, upon exposure, these compounds are isomerized, rearranged, cyclized, or crosslinked (Kosar, Chapter 4); layers containing compounds which can be photopolymerized, in which, on being exposed, monomers or prepolymers undergo polymerization, optionally with the aid of an initiator (Kosar, Chapter 5); and layers containing o-diazoquinones, such as naphthoquinone-diazides, p-diazoquinones, or condensation products of diazonium salts (Kosar, Chapter 7). The layers which are suitable also include the electrophotographic layers, i.e., layers which contain an inorganic or organic photoconductor. In addition to the photosensitive substances, these layers can, of course, also contain other constituents, such as for example, resins, dyes or plasticizers. In particular, the following photosensitive compositions or compounds can be employed in the coating of the support materials prepared in accordance with this invention:

positive-working reproduction layers which contain o-quinone diazides, preferably o-naphthoquinone diazides, such as high or low molecular-weight naphthoquinone-(1,2)-diazide-(2)-sulfonic acid esters or amides as the light-sensitive compounds, which are described, for example, in German Pat. Nos. 854,890; 865,109; 879,203; 894,959; 938,233; 1,109,521; 1,144,705; 1,118,606; 1,120,273; 1,124,817 and 2,331,377 and in European Pat. Nos. 0,021,428 and 0,055,814;

negative-working reproduction layers which contain condensation products from aromatic diazonium salts and compounds with active carbonyl groups, preferably condensation products formed from diphenylaminediazonium salts and formaldehyde, which are described, for example, in German Pat. Nos. 596,731; 1,138,399; 1,138,400; 1,138,401; 1,142,871 and 1,154,123; U.S. Pat. Nos. 2,679,498 and 3,050,502 and British Pat. No. 712,606;

negative-working reproduction layers which contain cocondensation products of aromatic diazonium compounds, such as are, for example, described in German Pat. No. 20 65 732, which comprise products possessing at least one unit each of a) an aromatic diazonium salt compound which is able to participate in a condensation reaction and b) a compound which is able to participate in a condensation reaction, such as a phenol ether or an aromatic thioether, which are connected by a bivalent linking member derived from a carbonyl compound which is capable of participating in a condensation reaction, such as a methylene group;

positive-working layers according to German Offenlegungsschrift No. 26 10 842, German Pat. No. 27 18 254 or German Offenlegungsschrift No. 29 28 636, which contain a compound which, on being irradiated, splits off an acid, a monomeric or polymeric compound which possesses at least one C-O-C group which can be split off by acid (e.g., an orthocarboxylic acid ester group or a carboxylic acid amide acetal group), and, if appropriate, a binder;

negative-working layers, composed of photopolymerizable monomers, photo-initiators, binders and, if appropriate, further additives. In these layers, for example, acrylic and methacrylic acid esters, or reaction products of diisocyanates with partial esters of polyhydric alcohols are employed as monomers, as described, for example, in U.S. Pat. Nos. 2,760,863 and 3,060,023, and in German Offenlegungsschriften Nos. 20 64 079 and 23 61 041;

negative-working layers according to German Offenlegungsschrift No. 30 36 077, which contain, as the photosensitive compound, a diazonium salt polycondensation product or an organic azido compound, and, as the binder, a high-molecular weight polymer with an alkenylsulfonylurethane or cycloalkenylsulfonylurethane side groups.

It is also possible to apply photosemiconducting layers to the support materials prepared in accordance with this invention, such as described, for example, in German Pat. Nos. 1,117,391, 1,522,497, 1,572,312, 2,322,046 and 2,322,047, as a result of which highly photosensitive electrophotographic printing plates are obtained.

From the coated offset printing plates prepared using the support materials produced in accordance with the present invention, the desired printing forms are obtained in a known manner by imagewise exposure or irradiation, followed by washing out the non-image areas by means of a developer, for example, an aqueous-alkaline developer solution.

The process according to the present invention combines, inter alia, the following advantages:

Even without a hydrophilizing post-treatment the non-image areas of printing plates are free from "staining" after development. This shows that the oxide surface produced in accordance with this invention is clearly superior to an oxide layer of comparable weight, which has been produced in an electrolyte containing $H_2SO_4$ or $H_3PO_4$ or a mixture of $H_2SO_4$ and $H_3PO_4$.

The resistance to alkali of the oxide produced is superior to the resistance to alkali of an oxide produced in an aqueous electrolyte containing $H_2SO_4$ or $H_3PO_4$ or a mixture of $H_2SO_4$ and $H_3PO_4$.

The oxide layer weight obtained can attain the weight of an oxide layer produced in a $H_2SO_4$-containing electrolyte, and thus, in respect of layer thickness, is superior to the oxide produced in customary $H_3PO_4$-containing electrolytes.

The oxide layer possesses good hydrophilic properties, so that a hydrophilizing posttreatment step, as known in the art of platemaking, can optionally be dispensed with.

Of the light impinging upon the support, a high fraction of more than 5 is directly reflected, which manifests itself in a bright appearance of the support, and therefore the support coated with a photosensitive layer has a markedly better resolution than supports of comparable graining structure, which have been anodized in other electrolytes than those of the present invention.

The very light non-image areas of the final printing form yield a strong contrast to the image areas, which is particularly advantageous in those cases, in which modern, optically working measuring instruments are used for measuring the proportions of image and non-image areas.

The photosensitive layers adhere extremely well to the support surfaces and, as a result, the print runs obtained with these printing plates are markedly higher than the print runs produced with printing plates having supports of comparable type, but which have not been anodized according to the present invention.

Mechanical abrasion is considerably lower than in the case of supports produced according to other methods, which have oxide layers of comparable weight.

The good conductivity of the electrolyte and the electrode systems make it possible to operate with lower voltages.

If, prior to graining, the aluminum is subjected to cleaning in an alkaline pickling agent, this pickling solution ca also be used for the anodizing treatment, provided it has a composition according to the present invention.

In the preceding description and in the examples which follow, percentages invariably denote percent by weight, unless otherwise specified. Parts by weight (p.b.w.) are related to parts by volume (p.b.v.) as the g is related to the $cm^3$. In the examples, the methods described below were employed to test the surface properties. The results of these tests are compiled in Tables I and II.

The following measuring methods were used:

A. Zincate test (according to U.S. Pat. No. 3,940,321, column 3, lines 29 to 68 and column 4, lines 1 to 8):

The rate of dissolution, in seconds, of an aluminum oxide layer in an alkaline zincate solution is a measure of the resistance to alkali of the layer. The longer the time required by the layer to dissolve, the higher is its resistance to alkali. The thicknesses of the layers should be approximately comparable, because they are, of course, also a parameter of the rate of dissolution. A drop of a solution composed of 500 ml of distilled water, 480 g of KOH, and 80 g of zinc oxide is applied to the surface to be tested, and the time taken for the metallic zinc to appear is measured, which is shown by a black staining of the area tested.

B. Determination of the weight per unit area of aluminum oxide layers by chemical dissolution (according to DIN 50944, March 1969 edition):

A solution composed of 37 ml of $H_3PO_4$ (density 1.71 g/ml at 20° C., corresponding to 85% strength $H_3PO_4$), 20 g of $CrO_3$, and 963 ml of distilled water is used to dissolve the aluminum oxide layer from the base metal, at a temperature of from 90° to 95° C., during 5 minutes. The resulting loss of weight is determined by weighing the sample prior to and after dissolving the layer. The loss of weight and the weight of the surface covered by the layer are then taken to calculate the weight per unit area of the layer, which is given in $g/m^2$.

C. To test the abrasion, an abrading wheel is moved over the surface of an uncoated plate sample, and the loss of weight of the surface, per unit area (relative to a standard treatment time), is determined. In the test, a Type 503 Taber-Abraser equipped with CS 10F wear wheels, manufactured by Teledyne Taber, North Tonawanda, U.S.A., was used. 200 revolutions were performed at a speed of 1 rps and under a weight of 500 g. The process for carrying out abrasion measurements of this kind is, for example, described in U.S. Pat. No. 2,287,148.

D. The reflectometer value at 60° was determined according to DIN 67 530 (January 1982 edition), the standard being described in chapter 4.2.1 of that DIN publication.

The invention will be illustrated by the following examples which are, however, not intended to constitute a limitation to the embodiments described therein.

EXAMPLES 1 TO 18

An 0.3 mm thick mill-finished aluminum sheet is degreased with an aqueous-alkaline pickling solution at a temperature in the range from 50° C. to 70° C. The aluminum surface is electrochemically grained in an electrolyte containing HCl, by means of an alternating current. For the subsequent anodic oxidation the following electrolytes are used:

| | | |
|---|---|---|
| 1. | 10.0 g/l of NaOH | (pH 13) |
| 2. | 8.0 g/l of NaOH | (pH 13) |
| | 1.5 g/l of $Na_2CO_3$ | |
| | 0.1 g/l of sodium octyl sulfate | |
| 3. | 0.6 g/l of NaOH | (pH 12.5) |
| | 0.4 g/l of $Na_2CO_3$ | |
| 4. | 5.0 g/l of NaOH | (pH 12.5) |
| | 1.0 g/l of sodium octyl sulfate | |
| 5. | 5.0 g/l of NaOH | (pH 12.5) |
| | 2.0 g/l of sodium aluminate | |
| 6. | 12.0 g/l of NaOH | (pH 12.7) |
| | 2.3 g/l of $Na_2CO_3$ | |
| | 0.2 g/l of sodium octyl sulfate | |
| 7. | 14.0 g/l of KOH | (pH 13.4) |
| 8. | 18 g/l of NaOH | (pH 12.6) |
| | 12 g/l of sodium borate | |

The quantitative ratios indicated above and in the text which follows are the ratios prevailing at the beginning of the anodizing process. They may change in the course of the process, in particular, by dissolution of aluminum from the anode material.

In all cases, the voltage used was 42 V (direct current) which enables easy handling in practice.

The results of the anodization are compiled in Table I. These results show that oxide layer weights of about 0.8 $g/m^2$ and preferably of about 2 $g/m^2$ or more can obviously be obtained using the electrolytes according to the present invention and that abrasion of the supports is low. All supports have an excellent resistance to alkali, as measured in the zincate test, and they all exhibit a silvery surface yielding a good reflectometer value at 60°, as measured according to DIN 67 530, and having the above-mentioned good properties.

TABLE I

| | Process Parameters | | | | | Surface Properties | | |
|---|---|---|---|---|---|---|---|---|
| Example No. | electrolyte No. | current density ($A/dm^2$) | temperature (°C.) | treatment time (s) | weight per unit area (g/m) | abrasion ($g/m^2$) | alkali resistance (s) | 60° reflectometer value |
| 1 | 1 | 5 | 30 | 60 | 1.52 | 0.11 | 265 | 53.0 |
| 2 | 1 | 10 | 30 | 60 | 2.54 | 0.03 | 180 | 66.6 |
| 3 | 1 | 15 | 30 | 30 | 2.32 | 0.07 | 205 | 79.4 |
| 4 | 2 | 20 | 20 | 30 | 1.68 | 0.09 | 180 | 37.2 |
| 5 | 2 | 20 | 20 | 60 | 4.08 | 0.04 | 295 | 47.3 |
| 6 | 2 | 20 | 40 | 30 | 1.84 | 0.04 | 270 | 46.9 |
| 7 | 2 | 30 | 40 | 60 | 2.04 | 0.05 | 195 | 53.2 |
| 8 | 2 | 30 | 40 | 60 | 2.16 | 0.04 | 160 | 55.6 |
| 9 | 2 | 15 | 15 | 30 | 1.80 | 0.07 | 325 | 41.2 |
| 10 | 3 | 10 | 25 | 60 | 0.80 | 0.27 | 185 | 22.5 |
| 11 | 4 | 30 | 30 | 20 | 1.80 | 0.30 | 240 | 15.0 |
| 12 | 5 | 5.5 | 20 | 20 | 2.24 | 0.03 | 210 | 35.3 |
| 13 | 5 | 6 | 25 | 20 | 1.72 | 0.17 | 205 | 32.3 |
| 14 | 5 | 4.2 | 30 | 20 | 1.84 | 0.08 | 230 | 39.6 |

TABLE I-continued

| Example No. | Process Parameters: electrolyte No. | current density (A/dm²) | temperature (°C.) | treatment time (s) | weight per unit area (g/m) | Surface Properties: abrasion (g/m²) | alkali resistance (s) | 60° reflectometer value |
|---|---|---|---|---|---|---|---|---|
| 15 | 6 | 20 | 20 | 60 | 4.04 | 0.04 | 195 | 62 |
| 16 | 7 | 5 | 30 | 60 | 0.84 | 0.15 | 220 | 62.3 |
| 17 | 7 | 10 | 30 | 60 | 1.56 | 0.20 | 225 | 64.5 |
| 18 | 8 | 30 | 30 | 45 | 2.52 | 0.15 | 255 | 15.0 |

In all examples the surfaces showed a silvery appearance.

COMPARATIVE EXAMPLES C 1 TO C 13

Other electrolytes than the alkaline electrolytes according to the present invention often tend to produce an insulating barrier layer in the anodizing process. At moderate voltages, this barrier layer allows a low current flow only and thus prevents the formation of sufficiently thick oxide layers within technically appropriate times. In addition, the supports usually do not show the desired gloss which is responsible for the abovementioned good properties.

If the electrolytes used contain, in addition to an alkali metal hydroxide, also salts of strong acids, for example sulfates, bright surfaces may be obtained, but these surfaces do not possess sufficiently thick oxide layers after an anodizing treatment under technically appropriate conditions. This is demonstrated by Comparative Examples 14 to 16. In the case of additives, the 1% strength aqueous solutions of which have only a weakly alkaline reaction (pH from 8.5 to 10.5), comparatively thin, light gray to dull gray surfaces are obtained, some of which show small specks resulting from microburns.

In the comparative tests, the voltage used was also 42 V. For most electrolytes this relatively high voltage was necessary to achieve an adequate current flow. The comparative tests were carried out with the following electrolytes:

| | | | |
|---|---|---|---|
| A. | Sodium acetate<br>not in accordance with this invention;<br>pH too low;<br>no alkali metal hydroxide. | 20.5 g/l | (pH 8) |
| B. | Sodium carbonate<br>not in accordance with this invention;<br>pH too low;<br>no alkali metal hydroxide. | 33 g/l | (pH 11.5) |
| C. | Sodium hydrogen carbonate<br>not in accordance with this invention;<br>pH too low;<br>no alkali metal hydroxide. | 10 g/l | (pH 8.6) |
| D. | Lithium hydroxide<br>not in accordance with this invention;<br>pH too low. | 5.8 g/l | (pH 11.9) |
| E. | Sodium acetate<br>NaOH<br>not in accordance with this invention;<br>pH too low;<br>too little alkali metal hydroxide. | 47.5 g/l<br>2.5 g/l | (pH 12.1) |
| F. | $Na_2CO_3$<br>NaOH<br>not in accordance with this invention;<br>pH too low;<br>too little alkali metal hydroxide. | 0.95 g/l<br>0.05 g/l | (pH 11.8) |
| G. | Sodium metasilicate<br>NaOH<br>not in accordance with this invention;<br>pH too low;<br>too little alkali metal hydroxide. | 9.9 g/l<br>0.1 g/l | (pH 12.4) |

TABLE II

| Example No. | Process Parameters: electrolyte No. | current density (A/dm²) | temperature (°C.) | treatment time (s) | weight per unit area (g/m²) | Surface Properties: abrasion (g/m²) | alkali resistance (s) | appearance | 60° reflectometer value |
|---|---|---|---|---|---|---|---|---|---|
| C1* | A | 1 | 30 | 30 | 0.56 | 0.4 | 62 | dull gray | 1.5 |
| C2* | B | 2 | 30 | 30 | 0.6 | 0.35 | 80 | light gray | 2.3 |
| C3 | B | 1 | 30 | 60 | 0.86 | 0.3 | 75 | light gray | 3.7 |
| C4 | C | 1 | 30 | 30 | 0.4 | 0.44 | 60 | dull gray | 1.8 |
| C5 | D | 2 | 30 | 30 | 0.47 | 0.3 | 55 | light gray | 2.5 |
| C6 | D | 2 | 30 | 60 | 0.64 | 0.33 | 50 | light gray | 1.7 |
| C7 | D | 3 | 30 | 60 | 1.1 | 0.2 | 55 | light gray | 1.8 |
| C8 | E | 1 | 25 | 60 | 0.3 | 0.35 | 35 | dull gray | 2.4 |
| C9 | E | 1 | 25 | 120 | 0.4 | 0.4 | 40 | dull gray | 2.1 |
| C10 | F | 1 | 25 | 60 | 0.5 | 0.25 | 58 | dull gray | 1.5 |
| C11 | F | 1 | 30 | 120 | 0.6 | 0.3 | 66 | dull gray | 1.3 |
| C12 | G | 2.5 | 25 | 60 | 0.2 | 0.43 | 52 | middle gray | 2.1 |
| C13 | G | 2.5 | 25 | 120 | 0.35 | 0.33 | 48 | middle gray | 2.2 |

*With small dark specks from microburns.

EXAMPLE 19

An aluminum substrate prepared in accordance with Example 8 is coated with a negative-working photosensitive layer of the following composition:

0.70 p.b.w. of the polycondensation product of 1 mole of 3-methoxy-diphenylamine-4 diazonium sulfate and mole of 4,4'-bis-methoxymethyl-diphenyl ether, precipitated as the mesitylene sulfonate, 3.40 p.b.w. of 85% strength phosphoric acid, 3.00 p.b.w. of a modified epoxide resin, obtained by reacting 50 parts by weight of an epoxide resin having a molecular weight of less than 1,000 and 12 8 parts by weight of benzoic acid in ethylene glycol monomethyl ether, in the presence of benzyltrimethylammonium hydroxide, 0.44 p.b.w. of finely-ground Heliogen Blue G (C.I. 74,100), 62.00 p.b.v. of ethylene glycol monomethyl ether, 30.60 p.b.v. of tetrahydrofuran, and 8.00 p.b.v. of butyl acetate.

After exposure through a negative mask, development is performed with a solution of 2.80 p.b.w. of $Na_2SO_4 \times 10\ H_2O$, 2 80 p.b.w. of $MgSO_4 \times 7\ H_2O$, 0.90 p.b.w. of 85% strength phosphoric acid, 0.08 p.b.w. of phosphorous acid, 1.60 p.b.w. of a non-ionic surfactant, 10.00 p.b.w. of benzyl alcohol, 20.00 p.b.w. of n-propanol, and 60.00 p.b.w. of water.

The printing plate produced in this way can be developed rapidly and without staining. 130,000 prints can be run with the resulting printing form. A support material prepared in accordance with Comparative Example C 7 and coated with the same composition can be developed only with difficulty. After development, yellow staining remains in the non-image areas, which is possibly caused by adhering particles of the diazonium compound. If a support material according to Comparative Example C 3 is used, gloss is stated in the nonimage areas during printing, after about 90,000 prints, which becomes stronger with an increasing number of prints. After 100,000 prints the copy quality has deteriorated to an industrially unacceptable degree.

EXAMPLE 20

An aluminum substrate prepared in accordance with Example 10 is coated with the following positive-working photosensitive solution:

6.00 p.b.w. of a cresol/formaldehyde novolak (softening range 105° to 120° C., according to DIN 53,181), 1.10 p.b.w. of the 4-(2-phenyl-prop-2-yl)phenyl ester of 1,2-naphthoquinone-2-diazide-4-sulfonic acid, 0.81 p.b.w. of polyvinyl butyral, 0.75 p.b.w. of 1,2-naphthoquinone-2-diazide-4-sulfonic acid chloride, 0.08 p.b.w. of crystal violet, and 91.36 p.b.w. of a solvent mixture comprised of 4 p.b.v. of ethylene glycol monomethyl ether, 5 p.b.v. of tetrahydrofuran and 1 p.b.v. of butyl acetate.

The coated web is dried in a drying tunnel at temperatures up to 120° C. The printing plate produced in this way is exposed through a positive original and developed with a developer of the following composition:

5.30 p.b.w. of $Na_2SiO_3 \times 9\ H_2O$, 3.40 p.b.w. of $Na_3PO_4 \times 12\ H_2O$, 0.30 p.b.w. of $NaH_2PO_4$ (anhydrous), 91.00 p.b.w. of water.

The resulting printing form exhibits very good processing and printing behavior and has excellent resolution. The number of prints that can be produced is 150,000.

A corresponding plate which has been prepared using the support material of Comparative Example C 6 shows blue staining in the non-image areas. If the developer is allowed to act on the plate over a prolonged period, there results a pronounced lightdark coloration in the non-image areas, which is a sign of the developer solution having attacked the oxide layer.

EXAMPLE 21

An aluminum substrate prepared in accordance with Example 16 is coated with the following negative-working photosensitive layer:

16.75 p.b.w. of an 8.0% strength solution of the reaction product of a polyvinyl butyral having a molecular weight of about 70,000 to 80,000 and being composed of 71% by weight of vinyl butyral units, 2% by weight of vinyl acetate units and 27% by weight of vinyl alcohol units, with propylene sulfonyl isocyanate, 2.14 p.b.w. of 2,6-bis-(4-azido-benzene)-4-methyl cyclohexanone, 0.23 p.b.w. of (R) Rhodamine 6 GDN extra, and 0.21 p.b.w. of 2-benzoyl-methylene-1-methyl-b-naphthothiazoline, in 100.00 p.b.w. of ethylene glycol monomethyl ether and 50.00 p.b.w. of tetrahydrofuran.

The dry layer has a weight of 0.75 g/m$^2$. By means of a 5 kW metal halide lamp the reproduction layer is exposed through a negative original for 35 seconds. A plush pad is used for treating the exposed layer with a developer solution composed of 5 p.b.w. of sodium lauryl sulfate, 1 p.b.w. of $Na_2SiO_3 \times 5\ H_2O$ and 94 p.b.w. of water, and the non-image areas are thus removed.

In a printing machine, the plate produces 170,000 prints. When a support material prepared in accordance with Comparative Example C 3 is employed, the adhesion of the reproduction layer is considerably reduced and, as a result, portions of the layer become detached from the image areas after printing about 120,000 copies only.

EXAMPLE 22

A support, which has been anodically oxidized as described in Example 5, is coated with the following solution for the production of an electrophotographic offset printing plate:

10.00 p.b.w. of 2,5-bis(4'-diethylaminophenyl)-1,3,4-oxadiazole, 10.00 p.b.w. of a copolymer of styrene and maleic anhydride, having a softening point of 210° C., 0.02 p.b.w. of (R)Rhodamine FB (C.I. 45,170), and 300.00 p.b.w. of ethylene glycol monomethyl ether.

By means of a corona, the layer is negatively charged in the dark to about 400 V. The charged plate is imagewise exposed in a reprographic camera and then developed with an electrophotographic suspension-type developer obtained by dispersing 3.0 p.b.w. of magnesium sulfate in a solution of 7.5 p.b.w. of pentaerythritol resin ester in 1,200 p.b.v. of an isoparaffin mixture having a boiling range of 185° to 210° C. After removal of excess developer liquid, the developer is fixed and the plate is immersed, during 60 seconds, in a solution comprised of 35 p.b.w. of $Na_2SiO_3 \times 9H_2O$, 140 p.b.w. of glycerol, 550 p.b.w. of ethylene glycol, and 140 p.b.w. of ethanol.

Then the plate is rinsed with a vigorous jet of water, whereby those areas of the photoconductor layer, which are not covered by toner, are removed. After rinsing, the plate is ready for printing. The non-image areas of the plate show a good hydrophilic character, and there are no signs of an attack even after the action of alkaline solutions. Several tens of thousands of good prints can be made from the printing form.

EXAMPLE 23

In an additional treatment step, an aluminum sheet prepared in accordance with Example 2 is immersed for 20 seconds into an 0.2% strength aqueous solution of polyvinylphosphonic acid at a temperature of 50° C. (additional hydrophilizing). After drying, the support material which has thus been given additional hydrophilic properties is processed as described in Example 19. By this treatment the ink-repelling character of the non-image areas can even be further improved.

What is claimed is:

1. A support material for offset printing plates comprising aluminum or an aluminum alloy which has been anodized in alkaline solutions, characterized by having a reflectometer value, at an angle of incidence of 60° (measured according to DIN 67 530; 1982), of greater than about 5, an abrasion of the oxide layer of less than about 0.5 $g/m^2$ and a resistance to alkali of greater than about 140 s.

2. A support material as claimed in claim 1, wherein the reflectometer value at 60° (measured according to DIN 67 530) is greater than or equal to about 15.

3. A support material as claimed in claim 1, wherein the abrasion of the oxide layer is less than or equal to about 0.3 $g/m^2$.

4. A support material as claimed in claim 1, wherein the resistance to alkali is greater than or equal to about 160 s.

5. A support material as claimed in claim 1, wherein the oxide layer has a weight per unit area of greater than about 0.8 $g/m^2$.

6. A support material as claimed in claim 2, wherein the abrasion of the oxide layer is less than about 0.3 $g/m^2$.

7. A support material as claimed in claim 6, wherein the resistance to alkali is greater than about 160 seconds.

8. A support material as claimed in claim 7, wherein the oxide layer has a weight per unit area of greater than about 0.8 $g/m^2$.

9. A process for the manufacture of a support material as claimed in claim 1, comprising a graining treatment and anodization of aluminum or an aluminum alloy, wherein the anodic oxidation is carried out in an aqueous alkaline electrolyte having a pH of greater than or equal to about 12.5 and the voltage used is less than about 50 V.

10. A process as claimed in claim 9, wherein the electrolyte comprises an alkali metal hydroxide.

11. A process as claimed in claim 10, wherein the electrolyte additionally comprises a salt, the aqueous solution of which has a strong alkaline reaction.

12. A process as claimed in claim 10, wherein the alkali metal hydroxide comprises sodium hydroxide.

13. A process as claimed in claim 11, wherein the electrolyte additionally comprises a sodium salt of a weak acid.

14. A process as claimed in claim 13, wherein the aqueous solution of the sodium salt has a pH of greater than about 10.5.

15. A process as claimed in claim 9, wherein the electrolyte additionally comprises a surface-active agent.

16. A process as claimed in claim 9, wherein anodization is carried out at a current density of from 3 to 50 $A/dm^2$ at a temperature between 10° C. and 50° C. and for a duration between 5 and 500 s, preferably between 10 and 300 s.

17. A process as claimed in claim 9, wherein the electrolyte comprises from 0.1 to 20% by weight of a substance having an alkaline reaction.

18. A process as claimed in claim 17, wherein the electrolyte comprises from 0.5 to 10% by weight of the substance having an alkaline reaction.

19. A process as claimed in claim 9, additionally comprising a hydrophilizing treatment following anodization.

* * * * *